US009375927B1

(12) United States Patent
Perego

(10) Patent No.: US 9,375,927 B1
(45) Date of Patent: Jun. 28, 2016

(54) APPARATUS AND PROCESS FOR DIGITAL PRINTING ON ARTICLES

(71) Applicant: TAPEMATIC S.P.A., Ornago (IT)

(72) Inventor: Luciano Perego, Merate (IT)

(73) Assignee: TAPEMATIC S.P.A., Ornago (IT)

( * ) Notice: Subject to any disclaimer, the term of this patent is extended or adjusted under 35 U.S.C. 154(b) by 0 days.

(21) Appl. No.: 14/750,694

(22) Filed: Jun. 25, 2015

(30) Foreign Application Priority Data

May 27, 2015 (EP) ..... 15425038

(51) Int. Cl.
*B41J 2/14* (2006.01)

(52) U.S. Cl.
CPC ..... *B41J 2/1433* (2013.01)

(58) Field of Classification Search
CPC ..... B41J 2/1433
USPC ..... 347/44
See application file for complete search history.

(56) References Cited

U.S. PATENT DOCUMENTS 3,796,718 A * 3/1974 Benford et al. ..... C03C 17/02 523/170
2015/0033964 A1 2/2015 Perego

FOREIGN PATENT DOCUMENTS

GB 2180195 A 3/1987

* cited by examiner

*Primary Examiner* — Jason Uhlenhake
(74) *Attorney, Agent, or Firm* — Pearne & Gordon LLP

(57) ABSTRACT

An apparatus for digital printing on articles (2), comprises a drum (3) rotatable about a central axis (C), carrying piece-holder elements (4) circumferentially distributed around said central axis (C) and each configured for carrying an article (2) being processed. The drum (3) rotates to transfer the piece-holder element (4) through printing stations (9) carrying printheads (10), each operating according to a printing area (15) of predetermined length (L), to create a printing pattern (M) on a side surface (2*a*) of each article (2), driven in rotation around its own axis (X). Auxiliary movement devices (21) shift the printhead (10) parallel to the main extension direction (D) of the printing area to allow the articles to be processed having an extension greater than the length of the printing area (15). It is also described a printing process implemented by the apparatus.

12 Claims, 3 Drawing Sheets

Fig.4
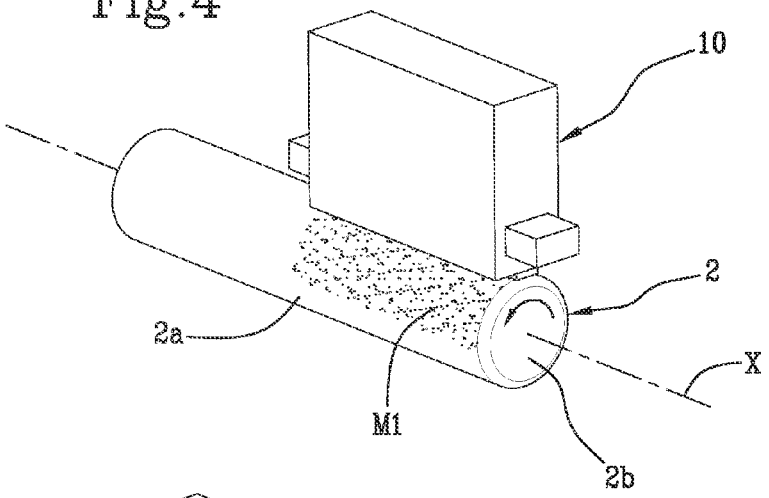
Fig.5
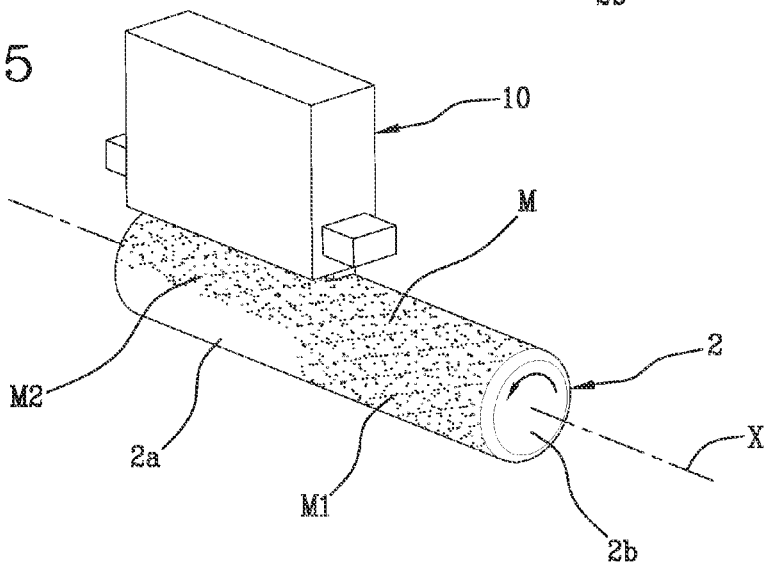
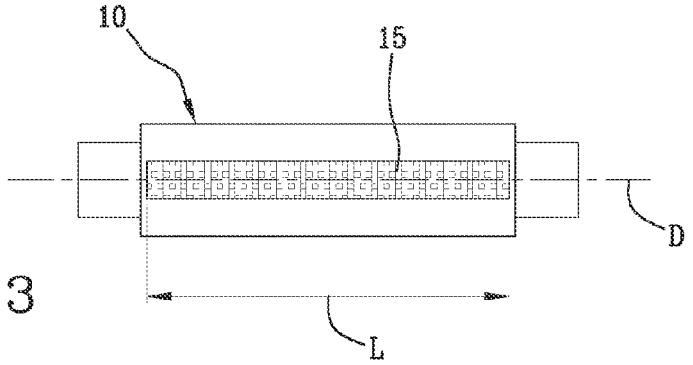
Fig.3

APPARATUS AND PROCESS FOR DIGITAL PRINTING ON ARTICLES

FIELD OF THE INVENTION

The present invention refers to an apparatus for digital printing on articles. It is also an object of the invention a method implementable by means of said apparatus.

More particularly, the invention aims to perform a digital printing, in particular an ink-jet digital printing, on articles such as bottles, tubes, containers, closure elements, and more generally any three-dimensional article comprising at least one side surface which extends around an extension axis of the object, and a base surface which can have an orientation perpendicular to said extension axis.

Such objects have preferably an axially symmetrical shape, for instance a cylindrical, conical or frusto-conical shape, with a circular base. In this case, the extension axis defines the axis of symmetry, the side surface is given by the surface wrapped around the extension axis, and the base surface is given from the base of the cylinder or the frusto-conical body. An alternative may provide a shape having an oval base, but where appropriate prismatic articles may be provided, for example having a quadrangular or polygonal base.

DESCRIPTION OF RELATED ART

The printing of decorations, lettering or symbols on the surface of such articles is known, for example to increase the aesthetic appearance, to bring product information, and/or to allow for their identification.

In this respect, one of the methods currently used comprises using the digital printing, which prints graphic patterns directly on the surfaces of articles from a computer data file, without the use of slabs, frames, plates, or the like.

For example, in the document US-2015-0033964-A1 by the same applicant, an apparatus for digital printing is described, comprising a rotatable drum carrying a plurality of gripping elements at its periphery, each adapted to the engagement of an article being processed. The drum is driven in rotation to shift sequentially the articles through one or more printing stations. In each printing station, at least one printhead operates, below which each piece-holder element is temporarily stationary to allow performing of printing. During the printing process, the printhead is face the side surface of the article so as to reproduce a desired printing pattern, by dispensing ink according to a plurality of points distributed along a substantially linear dispensing area, which is parallel to the extension axis of the article.

In the printing stage, the article is rotated about its longitudinal axis, or moved transversely with respect to the dispensing area, so as to transfer the printing pattern on the entire extension of the side surface around the extension axis.

In current equipment, where a relative movement between printhead and surface of the article in a direction transverse to the dispensing area is required, the amplitude of the side surface of the printable article with graphic patterns is dependent on the longitudinal size of the printhead, and in particular on the dispensing area thereof.

This circumstance precludes the use of digital printing techniques on articles whose sizes along the extension axis are higher than the length of the dispensing area of the printheads, which in many cases cannot exceed about 72 mm, excepting do this and resulting in high construction cost and/or functional complications.

For this reason, the use of the above equipment is currently limited to the processing of corks for bottles or vials, or other articles whose sizes along the extension axis do not exceed about 72 mm.

To overcome these limitations, it would currently be necessary to provide more printheads, optionally in respective working stations, respectively operating in axially staggered positions along the article being processed. The Applicant believes, however, that this solution is not technically feasible, at least in the equipment equipped with a rotary drum, excepting do this and producing a significant increase, even beyond the limits of acceptability, of the overall sizes and the structural and management complexity of the apparatus itself.

SUMMARY OF THE INVENTION

The main object of the present invention is to overcome the limits and the drawbacks of the prior art.

In particular, the invention aims to propose a printing apparatus, which is capable of reproducing graphic patterns also on the side surfaces of articles having a greater axial extension, for example, an axial extension even two or three times of the longitudinal dimension of the ink dispensing area from the printhead.

In accordance with a first aspect of the invention, the technical task mentioned and the aims specified are substantially achieved by an apparatus for digital printing on articles, comprising the technical characteristics set out in one or more of the appended claims.

In particular, in accordance with a first aspect, it is also an object of the invention an apparatus for digital printing on articles, comprising: a drum rotatable about a central axis; a plurality of piece-holder elements carried by the rotatable drum, which are circumferentially distributed around said central axis and each configured for carrying an article being processed; advancement devices operating on the rotatable drum to transfer the piece-holder elements sequentially through at least a printing station; and at least one printhead installed in said printing station and carrying ink dispensers distributed along a dispensing area having a main extension direction of predetermined length, wherein said ink dispensers are selectively activated to create a printing pattern on a side surface of the article carried by each piece-holder element. Transverse-movement devices provide the advancement of the side surface of the articles in the printing station transversely to the main extension direction of the dispensing area. In particular, other auxiliary movement devices are contemplated, for shifting the printhead parallel to the main extension direction of said dispensing area.

In accordance with a further aspect, it is an object of the invention a digital printing process on articles, comprising: loading a plurality of articles on the respective piece-holder elements distributed around a central axis of a rotatable drum; rotating the rotatable drum about said central axis to sequentially transfer the articles in a printing station comprising at least one printhead; printing a printing pattern on a side surface of each article carried in the printing station, while dispensing ink on points distributed along a dispensing area having a predetermined length in a main extension direction, while the side surface of the article is moved transverse to the dispensing area. In particular, it is provided that the printing of the printing pattern includes shifting the printhead parallel to the main extension direction of the dispensing area, to distribute the printing pattern on respectively adjacent longitudinal portions of said side surface. In fact, the Applicant has found that by shifting the printheads along the extension direction of the ink dispensing area, it becomes advantageously possible to increase the working area of the printheads without significantly affecting the constructive simplicity, the overall sizes, and the functional reliability of the whole apparatus.

In at least one of the above aspects, the invention also comprises one or more of the following preferred characteristics.

Preferably, said auxiliary movement devices are configured for shifting the printhead sequentially in successive movement steps.

It is thus possible to print the graphic pattern in several successive stages, while maintaining the printhead stationary while performing of each of them, for the benefit of the process precision.

Preferably, it also includes a control unit operating on the auxiliary movement devices and on the printhead to turn off the ink dispensers during the movement of the printhead.

Preferably, said auxiliary movement devices include: a support plate; a slider slidably engaged with the support plate and carrying said at least one printhead; control members operating between the support plate and the slider for shifting said at least one printhead.

Preferably, said slider extends through a through opening arranged in said support plate.

Preferably, the control members and the printhead are located on respectively opposite sides with respect to the support plate.

The sliding constraint between the slider and the support plate can therefore be approached to the printhead, for the benefit of guiding and positioning precision of the same.

Preferably, the control members comprise a worm screw driven by a drive motor and operatively engaged with the slider.

It is therefore possible to stop the printhead at any point of its stroke, which point being from time to time chosen according to the needs.

Preferably, each slider comprises a plate-like body placed below the support plate and constrained to the latter by means of sliding guides.

Preferably, at the plate-like body there is a mast, extending through said through-opening formed in the support plate.

Preferably, said printing station comprises ink supply devices comprising: a reservoir; a conditioning unit communicating with the reservoir through a supply duct and configured to supply said ink under controlled pressure and/or temperature conditions, in a delivery conduit confluent to the printhead.

Preferably, said conditioning unit is mounted on said slider.

The positioning of the conditioning unit on the slider favours the stability of the ink supply conditions at the printhead, for the benefit of the operation reliability and consistency.

Preferably, the ink-conditioning unit is engaged with the top of the mast.

Preferably, said transverse-movement devices include motors for the rotating drive of each piece-holder element around its extension axis.

It is thus also possible to perform the printing of articles having cylindrical or frusto-conical side surface, or to print on multiple sides the side surface of articles with a polygonal base.

Preferably, there are at least two printheads associated with the same printing station, arranged to each operate simultaneously on a respective article carried by one of said piece-holder elements.

The use of multiple printheads increases the productivity of the apparatus.

Preferably, said at least two printheads are integral with the same slider.

This results in a significant structural simplification of the apparatus.

Preferably, a plurality of said printing stations is provided, distributed around the central axis of the rotatable drum.

Preferably, said side surface has, parallel to the main extension direction, a dimension greater than the length of the dispensing area.

Preferably, the printhead shifts sequentially in successive movement steps.

Preferably, the ink dispensing is interrupted during the shifting of the printhead.

Preferably, the graphic pattern is printed in several successive stages, while maintaining the printhead stationary during the performing of each of them.

Preferably, provision is also made for the steps of: picking up the ink from a reservoir; transferring the ink to a conditioning unit mounted on a slider integral with the printhead; conferring to the ink predetermined pressure and/or temperature conditions by means of said conditioning unit; supplying the ink under the predetermined pressure and/or temperature conditions to the printhead, through a delivery conduit from said conditioning unit.

Preferably, the conditioning unit keeps a fixed positioning relative to the printhead during the shifting of the same.

Further characteristics and advantages of the present invention will become more apparent from the description of an exemplary, but not exclusive, and therefore non-limiting preferred embodiment of an apparatus and a process for digital printing on articles, as illustrated in the appended figures, in which:

BRIEF DESCRIPTION OF THE DRAWING

FIG. 3 is a bottom view of a printhead of the apparatus; and

FIGS. 4 and 5 show schematically the performing of the printing of a graphic pattern in accordance with the present invention.

DETAILED DESCRIPTION OF PREFERRED EMBODIMENTS OF THE INVENTION

Figure 1:
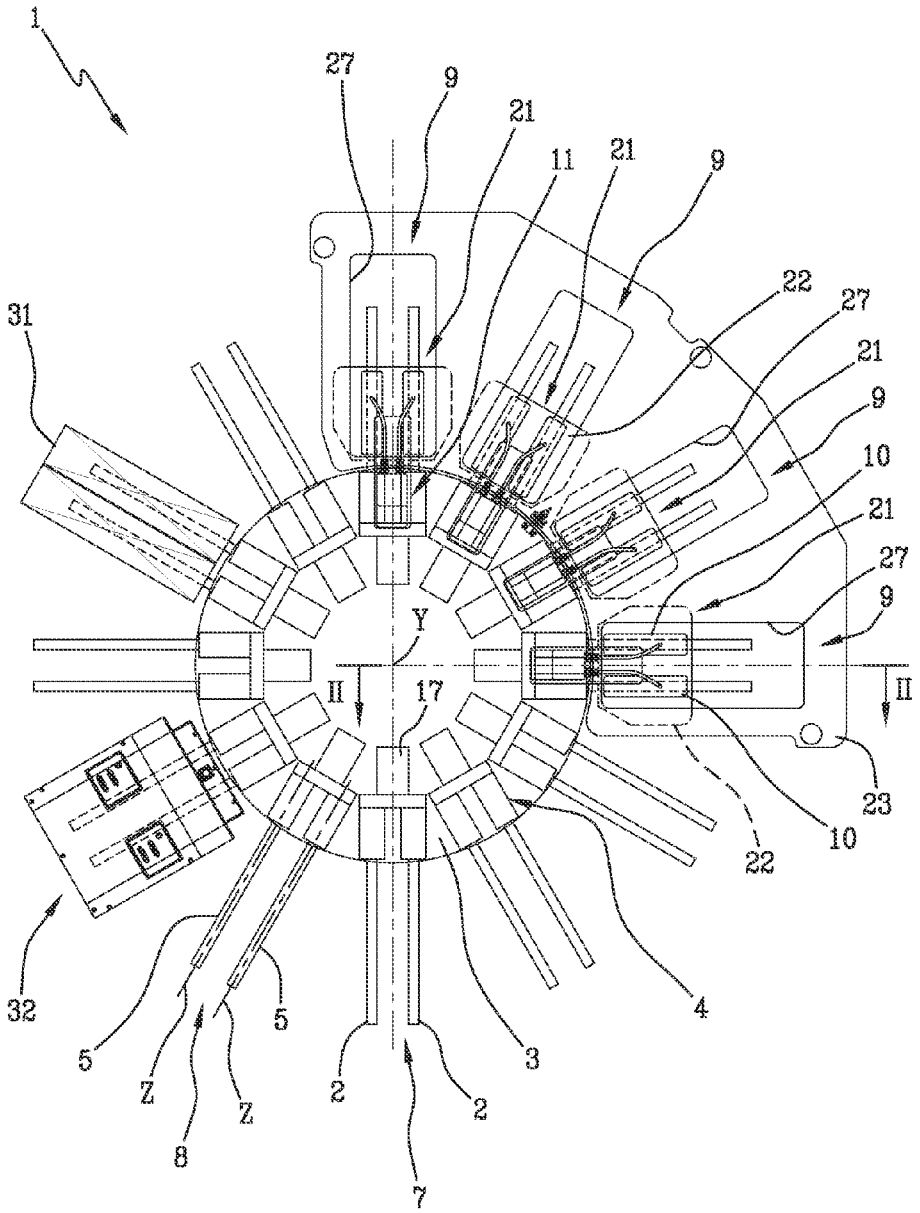
FIG. 1 shows a schematic top view of an apparatus according to the present invention.
Figure 2:
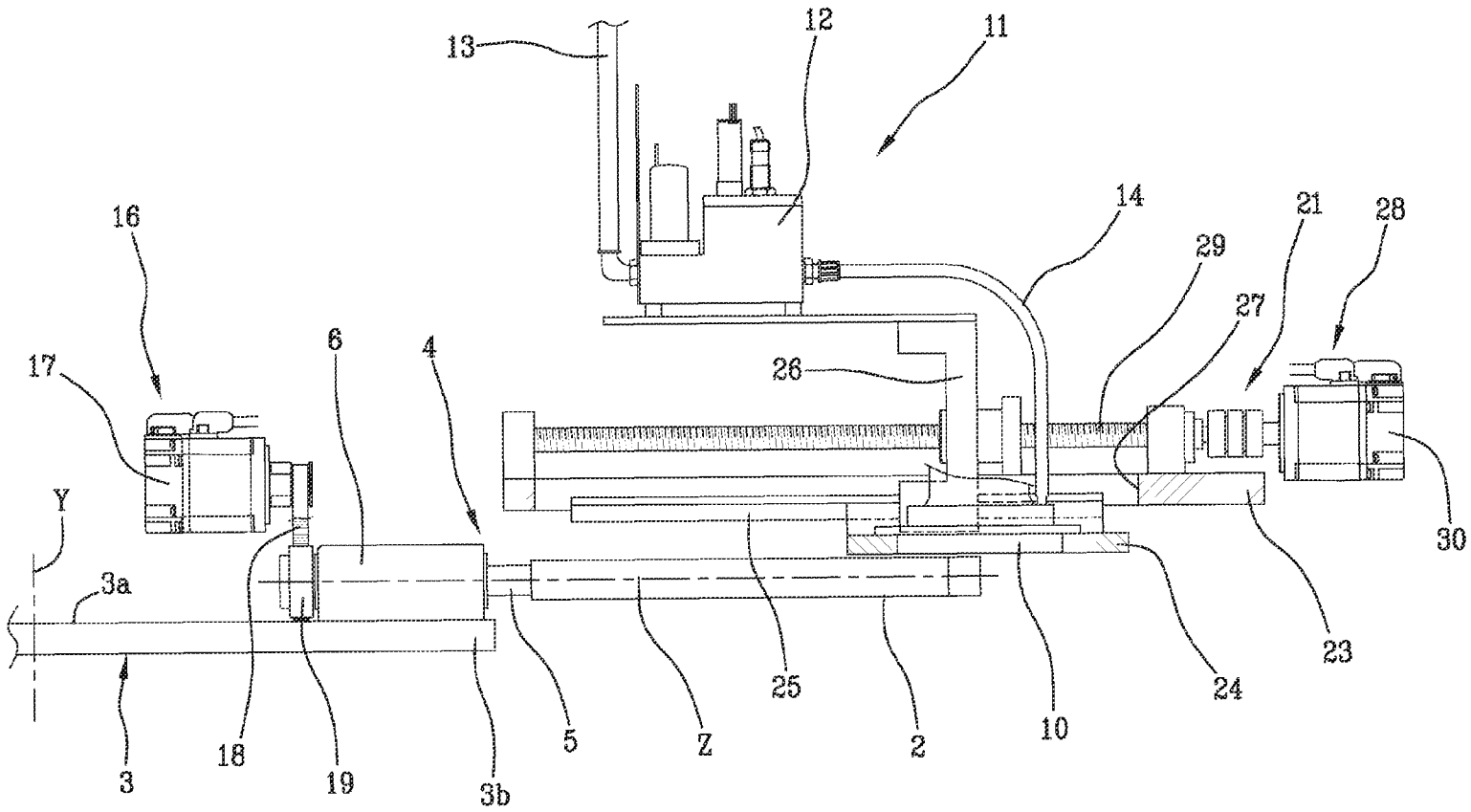
FIG. 2 shows a side view of one of the printing stations and a partial section view thereof taken along the line II-II of FIG. 1.

With reference to the attached figures, the number 1 globally indicates an apparatus for digital printing on articles 2, according to the present invention.

Each article 2 can be realized by an element, for example a prismatic, frusto-conical, or cylindrical element, as in the illustrated example, having at least one side wall defining a side surface 2*a* and at least a possible base wall 2*b*. Preferably, the side wall and the base wall define an internal cavity. It should be noted that other forms are suitable for the purpose, such as for example pyramid-shape prisms or oval-section cylinders.

In general, the side surface 2*a* extends around an extension axis X of the article 2. Typically, the extension axis X is a major extension axis, i.e., it defines the direction along which the article has the greater dimension.

The article 2 can be made with any material, for example plastic, metal, paper or vitreous material.

The apparatus 1 comprises a drum 3 rotatable about an own central axis Y. The drum 3 has an axially symmetrical shape with respect to its central axis Y, for example a substantially circular shape. The drum 3 has a base surface 3*a*, which is preferably flat, preferably horizontal. The central axis Y is preferably perpendicular to the base surface 3*a* of the drum 3. In other words, the central axis Y is arranged along a vertical direction.

Along a peripheral zone 3*b* of the drum 3, a plurality of piece-holder elements 4 is distributed, each being configured to accommodate a respective article 2 to be processed.

Each of the piece-holder elements 4, preferably coplanar with one another, includes for example a spindle 5 rotatably engaged to a support 6 integral with the drum 3. Preferably, each spindle 5 extends away from the support 6, in a radial direction with respect to the central axis Y, for example along a longitudinal axis Z parallel to the surface 3*a* of the drum 3. Each spindle 5 is suitable to engage one of the articles 2, which is, for example, coaxially fitted on the spindle itself, and to suitably hold them during the processing, for example by means of a suction action exerted by the spindle itself.

By means of suitable advancement devices, which are not illustrated since realizable in a known manner, the drum 3 is suitable to be driven in rotation around its own central axis C, preferably by a step-by-step movement, to sequentially transfer the piece-holder elements 4 through a plurality of stations distributed around the drum itself.

More particularly, there is provided a loading station 7 in which the articles 2 coming, for example, from a feed line 7*a* are loaded sequentially on each spindle 5 of one of the piece-holder elements 4.

In an unloading station 8, preferably placed adjacent the loading station 7, the articles 2 processed are removed from the respective piece-holder elements 4.

The rotation of the drum 3 causes the articles 2 to be transferred along a circular path around its own central axis Y, from the loading station 15 to unloading station 16, which are not described in detail since realizable in a known manner.

Among the loading station 7 and unloading station 8, along the path traveled by the articles moved around the central axis C of the drum 3, one or more printing stations 9 operate. In the example shown, where the apparatus 1 is designed for four-colour CMYK printing, there are four printing stations 9, each used to print with a respective colour, i.e., Yellow, Magenta, Cyan, and Black, respectively.

Through the rotation of the drum 3, each of the articles 2 carried by the piece-holder elements 4 is sequentially subjected to the action of each of the printing stations 9, so that on its side surface 2*a* an image can be reproduced, for example a four-colour image, that is, an image resulting from the composition of four graphic patterns respectively produced with the various colours, each in one of the printing stations 9. The production of one-colour images, or of two or more colours images by means of the activation of a corresponding number of printing stations, is also contemplated.

Each printing station 9 comprises at least one printhead 10 adapted to operate on the side surface 2*a* of the respective article 2 being processed. The printhead 10 may be of the ink-jet type, preferably interlocked with ink supply devices 11 comprising a reservoir (not shown) and a conditioning unit 12 communicating with the reservoir through a supply conduit 13. The conditioning unit 12, not described in detail since realizable in a known manner, is configured to supply ink under controlled pressure and/or temperature conditions, in at least a delivery duct 14 confluent to the printhead 10.

In a known manner, each printhead 10 has, on a side facing the piece-holder elements 4, which is its lower side in the illustrated example, a plurality of ink dispensers having infinitesimal size and distributed at close distance with one another along one or more directions, preferably rectilinear and parallel with one another, so as to define a dispensing area having an elongated shape and a predetermined length L, for example in the order of 70 mm. A main extension direction D of the ink dispensing area 15 is preferably parallel to the extension axis X of the article 2 subjected to the action of the same printhead 10.

The ink dispensers of each printhead 10 are selectively activated to create a printing pattern M on the side surface 2*a* of the respective article 2 subjected to the action of the same printhead, while suitable transverse-movement devices 16 translate the same side surface 2*a* transversely with respect to the main extension direction D of the dispensing area 15.

The transverse-movement devices 16 may for example comprise one or more motors 17 for driving in rotation of each piece-holder element 4. More particularly, each motor 17 can be fixed to the drum 3 for driving the spindle 5 in rotation about its longitudinal axis Z. The resulting rotational drive of the article 2 around its extension axis X determines the above-described transverse movement of the side surface 2*a*. In a preferential solution, each motor 17 is interlocked with a pair of piece-holder elements 4, preferably having longitudinal axes Z parallel to each other. For example, a toothed belt 18 cooperating with respective pulleys 19 operatively connects each motor 17 to the spindles 5 of the respective piece-holder elements 4. Consequently, the pair of articles 2 processed in a same printing station 9 are simultaneously driven in rotation by the same motor 17.

Alternatively, for example during the processing of articles 2 with a prismatic shape, the transverse movement of the side surface 2*a* may be achieved by rotating the drum 3 about its own central axis C.

The size of the articles 2 and, therefore, of their side surfaces 2*a* along the extension axis X, can advantageously be greater, possibly more than twice the predetermined length of the dispensing area 15 along its main extension direction D. To allow the realization of graphic patterns M along the entire side surface 2*a* of each article 2, it is advantageously provided that at each printing station 9 auxiliary movement devices 21 are associated, which are configured for shifting the printhead 10 along the main extension direction D of the dispensing area 15.

More particularly, it is preferably provided that each printhead 10 is fixed to a slider 22 slidably guided to a support plate 23, for example arranged horizontally above the drum 3, parallel to the base surface 3*a* of the same. In the illustrated example, a single support plate 23 slidably engages the sliders 22 of all the printing stations 9. It may be provided that the support plate 23 is positioned parallel to the central axis C of the drum 3, so as to simultaneously adjust the positioning of the printheads 10 to the processing of articles 2 with different diameters.

Preferably, each slider 22 comprises a plate-shaped body 24 located below the support plate 23 and constrained to the latter by means of sliding guides 25. From the plate-shaped body 24 there is a mast 26 extending through a through opening 27 formed in the support plate 23.

In each working station, control members 28 acting between the support plate 23 and each slider 22 allow the printhead 10 to be moved parallel to the longitudinal axes of the spindles 5, i.e. along the main extension direction D of the dispensing areas 15. Preferably, the control members 28 and the printhead 10 are placed on sides respectively opposite to the support plate 23. In this way, the overall sizes of the control members 28 do not hinder a close positioning between the sliding guides 25 and the printheads 10, for the benefit of guiding precision and positioning thereof. The control members 28 may for example comprise a worm screw 29 rotatably supported with respect to the support plate 23, drivable in rotation by a motor 17. The worm screw 29 engages operatively a female screw placed in the mast 26 of the slider 22, so as to determine a linear motion thereof, together with the printheads 10, following rotations imposed by the motor 17.

In the example illustrated, in each printing station 9 two printheads 10 are installed, which are preferably parallel with one another, each operating simultaneously on one of the articles 2 carried respectively by the pair of piece-carrying elements 4 placed in the printing station 9. Preferably, the printheads 10 installed in each of the printing stations 9 are fixed to a same slider 22, with the respective dispensing areas 15 facing from the lower surface of the plate-shaped body 24, towards the side surfaces of the articles 2.

To the slider 22 of each printing station 9, preferably at the top of the mast 26, the ink-conditioning unit 12 can be advantageously fixed. The conditioning unit 12 can be so placed in close position with respect to each printhead 10, and maintains a fixed position with respect to each printhead 10 during its shifting. It is thus possible to limit the length of the delivery ducts 14 and prevent their deformation due to the movement of the printheads 10, for the benefit of stability of the pressure and/or temperature conditions of the ink supplied to the printheads themselves.

The reservoir can be in turn installed in a fixed position with respect to the supporting structure of the apparatus 1, possibly spaced from the printing station 9 so as to be easily accessible for the replacement or refilling operations.

An electronic control unit, not shown in the accompanying drawings, controls the operation of the apparatus 1.

The control unit can be divided into distinct functional modules (memory modules or operating modules) or else constituted by a single electronic device, suitably programmed to perform the described functionalities, in which the various modules may correspond to hardware entities and/or software routines forming part of the programmed device.

Alternatively or in addition, such functionalities can be performed by a plurality of electronic devices on which the previously mentioned functional modules can be distributed.

The control unit may use one or more processors for executing the instructions contained in the memory modules. In addition, these functional modules can be distributed over several, local or remote computers according to the network architecture in which they reside.

More particularly, by way of indication, the control unit may comprise at least one processing module programmable with the files relating to the graphic patterns M to be printed on the articles 2 being processed. An actuation module acquires signals from the processing module and controls the selective dispensing of the ink from the dispensing nozzles, in conjunction with the actuation of the transverse-movement devices 16, which, by driving in rotation the articles 2, determine the displacement of their side surfaces 2*a* transversely to the main extension direction D of the dispensing areas 15.

The control unit is also configured to control the auxiliary movement devices 21, so as to translate the printhead 10 parallel to the main extension direction D of the dispensing area 15. The printing pattern M is therefore distributed on respectively adjacent longitudinal portions M1, M2 of said side surface 2*a*, so that it can cover the entire side surface 2*a*, or a longitudinal portion of the same larger than the longitudinal extension of the dispensing area 15.

Preferably, upon command of the control unit, the auxiliary movement devices 21 are adapted to shift the printhead 10 sequentially in successive movement steps, so that each printing pattern M is printed in several successive stages, while maintaining the printhead 10 stationary during the performing of each stage.

More particularly, at the end of the performing of a first portion M1 of the printing pattern M on a first longitudinal portion of the side surface 2*a*, the control unit determines the deactivation of all ink suppliers, and determines the shifting of the printhead 10 following the action of the auxiliary movement devices 21. Once positioned the printhead 10 on a subsequent longitudinal portion of the side surface 2*a*, the ink dispensers are activated again to resume the creation of the printing pattern M, realizing a second portion M2 juxtaposed to the previously printed first portion M1.

Therefore, by shifting the printheads 10 in successive movement steps, printing patterns M on articles 2 of considerable length can be realized, with a length that can be several times greater than the longitudinal dimension of the ink dispensing area 1 from the individual printheads 10. The printing operation of the graphic pattern can be repeated in each of the printing stations 9, for the realization of a polychromatic image, for example a four-colour image.

Once the printing is complete, successive angular rotations of the drum 3 bring the articles to the unloading station 8, after a passage through a possible cross-linking station 31 for the ink used in the printing, and a final control station 32.

The invention claimed is:

1. Apparatus for digital printing on articles, comprising:

a drum rotatable about a central axis;

a plurality of piece-holder elements carried by the rotatable drum, circumferentially distributed around said central axis and each configured for carrying an article being processed;

advancement devices operating on the rotatable drum to transfer the piece-holder elements sequentially through at least a printing station;

at least one printhead installed in said printing station and carrying ink dispensers distributed along a dispensing area having a main extension direction of predetermined length parallel to the extension axis of the article, wherein said ink dispensers are selectively activated to create a printing pattern on a side surface of the article carried by each piece-holder element;

transverse-movement devices for translating the side surface of the articles in the printing station transversely to the main extension direction of the dispensing area; auxiliary movement devices configured for shifting the printhead parallel to the main extension direction of the dispensing area, and sequentially in successive movement steps to print the printing pattern on respectively adjacent longitudinal portions of said side surface in several successive printing stages, while maintaining the printhead stationary during performance of each printing stage; and a control unit operating on the auxilliary movement devices and on the printhead to turn off the ink dispensers during each movement step of the printhead.

2. Apparatus according to claim 1, in which said printing station comprises:

a support plate;

a slider slidably engaged with the support plate and carrying said at least one printhead;

control members operating between the support plate and the slider for shifting said at least one printhead.

3. Apparatus according to claim 2, wherein the control members comprise a worm screw driven by a drive motor and a support bearing said at least one printhead.

4. Apparatus according to claim 2, wherein said slider extends through a through opening arranged in said support plate.

5. Apparatus according to claim 2, wherein said printing station comprises ink supply devices comprising:

a reservoir;

a conditioning unit communicating with the reservoir through a supply duct and configured to supply said ink under controlled pressure and/or temperature in a delivery conduit confluent to the printhead, wherein said conditioning unit is mounted on said support plate near the printhead.

6. Apparatus according to claim 1, wherein said transverse-movement devices include motors for the rotating drive of each piece-holder element around its extension axis.

7. Apparatus according to claim 1, comprising at least two printheads associated with the same printing station, each arranged to operate simultaneously on a respective article carried by one of said piece-holder elements.

8. Digital printing process on articles, comprising:

loading a plurality of articles on respective piece-holder elements distributed around a central axis of a rotatable drum;

rotating the rotatable drum about said central axis to sequentially transfer the articles in a printing station comprising at least one printhead;

printing a printing pattern on a side surface of each article carried in the printing station, while dispensing ink on points by ink dispensers, said points and ink dispensers being distributed along a dispensing area having a predetermined length in a main extension direction, while the side surface of the article is moved transverse to the main extension direction of the dispensing area, wherein printing the printing patter includes distributing the printing pattern on respectively adjacent longitudinal portions of said side surface in several successive printing stages, by shifting the printhead sequentially in successive movement steps parallel to the main extension direction of the dispensing area, wherein ink dispensing is interrupted during movement of the printhead, and the printhead is maintained stationary during performing of each of said printing stages.

9. Process according to claim 8, wherein said side surface has, parallel to the main extension direction, a dimension greater than the length of the dispensing area.

10. Printing process according to claim 8, further comprising the steps of:

picking up the ink from a reservoir;

transferring the ink to a conditioning unit mounted on a slider integral with the printhead;

conferring to the ink predetermined pressure and/or temperature conditions by means of said conditioning unit;

supplying the ink under the predetermined pressure and/or temperature conditions to the printhead, through a delivery conduit from said conditioning unit.

11. Digital printing process on articles, comprising:

loading a plurality of articles on respective piece-holder elements distributed around a central axis of a rotatable drum;

rotating the rotatable drum about said central axis to sequentially transfer the articles in a printing station comprising at least one printhead;

printing a printing patter on a side surface of each article carried in the printing station, while dispensing ink on points distributed along a dispensing area having a predetermined length in a main extension direction, while the side surface of the article is moved transverse to the dispensing area, wherein printing the printing pattern includes shifting the printhead parallel to the main extension direction of the dispensing area, to distribute the printing pattern on respectively adjacent longitudinal portions of said side surface, further comprising the steps of:

picking up the ink from a reservoir;

transferring the ink to a conditioning unit mounted on a slider integral with the printhead;

conferring to the ink predetermined pressure and/or temperature conditions by means of said conditioning unit;

supplying the ink under the predetermined pressure and/or temperature conditions to the printhead, through a delivery conduit from said conditioning unit.

12. Apparatus for digital printing on articles, comprising:

a drum rotatable about a central axis;

a plurality of piece-holder elements carried by the rotatable drum, circumferentially distributed around said central axis and each configured for carrying an article being processed;

advancement devices operating on the rotatable drum to transfer the piece-holder elements sequentially through at least a printing station;

at least one printhead installed in said printing station and carrying ink dispensers distributed along a dispensing area having a main extension direction of predetermined length, parallel to the extension axis of the article, wherein said ink dispensers are selectively activated to create a printing pattern on a side surface of the article carried by each piece-holder element;

transverse-movement devices for translating the side surface of the articles in the printing station transversely to the main extension direction of the dispensing area;

auxiliary movement devices for shifting the printhead parallel to the main extension direction of the dispensing area, wherein said printing station comprises:

a support plate;

a slider slidably engaged with the support plate and carrying said at least one printhead;

control members operating between the support plate and the slider for shifting said at least one printhead parallel to the main extension direction of the dispensing area.

* * * * *